US008075707B2

(12) United States Patent
Nakamura et al.

(10) Patent No.: US 8,075,707 B2
(45) **Date of Patent: *Dec. 13, 2011**

(54) METHOD FOR PREPARING RARE EARTH PERMANENT MAGNET MATERIAL

(75) Inventors: Hajime Nakamura, Echizen (JP); Takehisa Minowa, Echizen (JP); Koichi Hirota, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 568 days.

This patent is subject to a terminal disclaimer.

(21) Appl. No.: 11/916,506

(22) PCT Filed: Mar. 28, 2007

(86) PCT No.: PCT/JP2007/056594

§ 371 (c)(1),
(2), (4) Date: Dec. 4, 2007

(87) PCT Pub. No.: WO2007/119553

PCT Pub. Date: Oct. 25, 2007

(65) Prior Publication Data

US 2009/0098006 A1 Apr. 16, 2009

(30) Foreign Application Priority Data

Apr. 14, 2006 (JP) ..... 2006-112286

(51) Int. Cl.
*H01F 1/057* (2006.01)

(52) U.S. Cl. ..... 148/122; 148/101; 148/302

(58) Field of Classification Search ..... None
See application file for complete search history.

(56) References Cited

U.S. PATENT DOCUMENTS

| | | | | |
|---|---|---|---|---|
| 5,034,146 | A | 7/1991 | Ohashi et al. | |
| 5,858,124 | A | 1/1999 | Endo et al. | |
| 6,606,019 | B1 | 8/2003 | Ohashi | |
| 6,960,240 | B2 | 11/2005 | Hirota et al. | |
| 2003/0079805 | A1 | 5/2003 | Hamada et al. | |
| 2006/0213582 | A1* | 9/2006 | Nakamura et al. | 148/302 |
| 2006/0213583 | A1* | 9/2006 | Nakamura et al. | 148/302 |
| 2006/0213584 | A1* | 9/2006 | Nakamura et al. | 148/302 |
| 2006/0213585 | A1* | 9/2006 | Nakamura et al. | 148/302 |
| 2007/0017601 | A1 | 1/2007 | Miyata et al. | |
| 2007/0034299 | A1 | 2/2007 | Machida et al. | |
| 2007/0240788 | A1 | 10/2007 | Nakamura et al. | |
| 2007/0240789 | A1 | 10/2007 | Nakamura et al. | |
| 2008/0054736 | A1 | 3/2008 | Miyata et al. | |
| 2008/0223489 | A1 | 9/2008 | Nagata et al. | |
| 2008/0245442 | A1 | 10/2008 | Nakamura et al. | |
| 2008/0247898 | A1 | 10/2008 | Nakamura et al. | |
| 2009/0226339 | A1 | 9/2009 | Nakamura et al. | |

FOREIGN PATENT DOCUMENTS

| | | | |
|---|---|---|---|
| EP | 1267365 | A2 | 12/2002 |
| EP | 1643513 | A1 | 4/2006 |
| EP | 1746611 | A1 | 1/2007 |
| EP | 1830371 | A1 | 9/2007 |
| JP | 4-328804 | A | 11/1992 |
| JP | 5-21218 | A | 1/1993 |
| JP | 5-212218 | A | 1/1993 |
| JP | 5-31807 | B2 | 5/1993 |
| JP | 6158238 | A | 6/1994 |
| JP | 6-244011 | A | 9/1994 |
| JP | 3471876 | B2 | 12/2003 |
| JP | 2005-11973 | A | 1/2005 |
| JP | 2007-53351 | A | 3/2007 |
| WO | 2006-043348 | A1 | 3/2005 |

OTHER PUBLICATIONS

Hajime Nakamura, et al., "Microstructures of the anisotropic Nd-Fe-B HDDR treated powder," The Papers of Technical Meeting on Magnetics, Nov. 17, 1998, pp. 31-36, Technical Meeting on Magnetics, The Institute of Electrical Engineers of Japan.

Supplementary European Search Report dated Mar. 22, 2010, issued in corresponding European Patent Application No. 07740032.3.

International Search Report of PCT/JP2007/056594, date of mailing Jul. 10, 2007.

K.-D. Durst et al.; "The Coercive Field of Sintered and Melt-Spun NdFeB Magnets", Journal of Magnetism and Magnetic Materials, vol. 68, pp. 63-75, 1987.

K.T. Park et al.; "Effect of Metal-Coating and Consecutive Heat Treatment on Coercivity of Thin Nd-Fe-B Sintered Magnets", Proceedings of the Sixteenth International Workshop on Rare-Earth Magnets and Their Applications, The Japan Institute of Metals, 2000, pp. 257-264.

K. Machida et al.; "Grain Boundary Tailoring of Nd-Fe-B Sintered Magnets and Their Magnetic Properties", Proceedings of the 2004 Spring Meeting of the Powder & Powder Metallurgy Society, p. 202.

"Nd-Fe-B Based Sintered Magnet Processed to Ultraminiature Size"; The Journal of the Institute of Electrical Engineers of Japan, vol. 124, No. 11, 2004, pp. 699-702, published Nov. 1, 2004.

"Shin-Etsu Chemical, develops new high-performance technology for neodymium rare-earth magnets"; Press Release (Shin-Etsu News) dated Mar. 24, 2005.

(Continued)

*Primary Examiner* — John Sheehan

(74) *Attorney, Agent, or Firm* — Westerman, Hattori, Daniels & Adrian, LLP

(57) ABSTRACT

A method for preparing a rare earth permanent magnet material comprises the steps of disposing a powder on a surface of a sintered magnet body of $R^1{}_aT_bA_cM_d$ composition wherein $R^1$ is a rare earth element inclusive of Sc and Y, T is Fe and/or Co, A is boron (B) and/or carbon (C), M is Al, Cu, Zn, In, Si, P, S, Ti, V, Cr, Mn, Ni, Ga, Ge, Zr, Nb, Mo, Pd, Ag, Cd, Sn, Sb, Hf, Ta, or W, said powder comprising an oxide of $R^2$, a fluoride of $R^3$ or an oxyfluoride of $R^4$ wherein $R^2$, $R^3$, and $R^4$ are rare earth elements inclusive of Sc and Y and having an average particle size equal to or less than 100 μm, heat treating the magnet body and the powder at a temperature equal to or below the sintering temperature of the magnet body for absorption treatment for causing $R^2$, $R^3$, and $R^4$ in the powder to be absorbed in the magnet body, and repeating the absorption treatment at least two times. According to the invention, a rare earth permanent magnet material can be prepared as an R—Fe—B sintered magnet with high performance and a minimized amount of Tb or Dy used.

23 Claims, No Drawings

OTHER PUBLICATIONS

"Technology developed for enhancing heat resistance of Nd magnets"; The Nikkan Kogyo Shimbun (Mar. 25, 2005).
"Shin-Etsu Chemical develops advanced high-performance technology—High heat resistance as well as flux density of residual magnetization—Neodymuim rare-earth magnets"; The Dempa Shimbun (Mar. 25, 2005).
"Coercive force, enhanced by 30%—Neodymium magnets—by Shin-Etsu Chemical, though a new idea as to arrangement of rare-earth elements"; The Kagaku Kogyo Shimbun (The Chemical Daily)(Mar. 25, 2005).
"Shin-Etsu Chemical, develops new advanced high-performance technology for Nd magnets—Will begin sample shipments by the end of 2005 and aim at starting mass production in 2006"; The Sekiyu Kagaku Shimbun Nikkan Tsushin (Mar. 25, 2005).
"Shin-Estu Chemical, develops advanced high-performance technology for neodymium rare earth magnets";The Nikkan Chemical News (Mar. 25, 2005).
"Shin-Estu Chemical, develops new high-performance technology for neodymium rare-earth magnet"; Nikkei Press Release, March 25, 2005.
H. Nakamura et al.; "Magnetic Properties of Extremely Small Nd-Fe-B Sintered Magnet"; InterMag Asia 2005; Digests of the IEEE International Magnetics Conference; p. 476; held on Apr. 4-8, 2005.
Techno-Frontier Symposium 2005; pp. B1-2-1 to B1-2-12; held on Apr. 20, 2005 by JMA.
Hajime Nakamura et al.; "Magnetic Properties of Extremely Sma;; Nd-Fe-B Sintered Magnets"; IEEE Transactions on Magnetics, vol. 41, No. 10, Oct. 2005, pp. 3844-3846.
Abstract of Autumn Meeting of Japan Society of Powder and Powder Metallurgy, 2005; "Production of Nd-Fe-B Sintered Magnet with Higher Coercive Force by Grain Boundary Diffusion" p. 143; held on Nov. 14-16, 2005.
2005 BM Symposium, Abstract of Presentation by the Japan Association of Bondet Magnet Industries, held on Dec. 2, 2005.
H. Nakamura; "Nd-Fe-B Sintered Magnets Produced by the Grain Boundary Diffusion Process"; Bulletin of Topical Symposium of the Magnetics Society of Japan, Mar. 14, 2006, pp. 13-18, Hajime Nakamura.
K. Hirota et al.; "Coercivity Enhancement by Grain Boundary Diffucion Process to Nd-Fe-B Sintered Magnets."; IEEE International Magnetics Conference, May 8-12, 2006, p. 910.
H. Nakamura et al.; "Microstructures of High Coercivity Nd-Fe-B Sintered Magnets Produced by the Grain Boundary Diffusion Process"; Digest of the 30th Annual Conference on Magnetics in Japan 2006, pp. 417-418.
K.D. Durst et al.; "The Coercive Field of Sintered and Melt-Spun NdFeB Magnets"; Journal of Magnetism and Magnetic Materials, vol. 68, (1987), pp. 63-75.
K. T. Park et al.; "Effect of Metal-Coating and Consecutive Heat Treatment on Coercivity of Thin Nd-Fe-B Sintered Magnets"; Proceedings of the Sixteenth International Workshop on Rare-Earth Magnets and Their Applications, Sendai, (2000), p. 257.
Kenichi Machida et al.; "Grain Boundary Modification and Magnetic Properties of Nd-Fe-B Sintered Magnets", Proceedings of the 2004 Spring Meeting of the Powder & Powder Metallurgy Society, p. 202.

* cited by examiner

METHOD FOR PREPARING RARE EARTH PERMANENT MAGNET MATERIAL

TECHNICAL FIELD

This invention relates to a method for preparing a high-performance rare earth permanent magnet material having a reduced amount of expensive Tb or Dy used.

BACKGROUND ART

By virtue of excellent magnetic properties, Nd—Fe—B permanent magnets find an ever increasing range of application. The recent challenge to the environmental problem has expanded the application range of these magnets from household electric appliances to industrial equipment, electric automobiles and wind power generators. It is required to further improve the performance of Nd—Fe—B magnets.

Indexes for the performance of magnets include remanence (or residual magnetic flux density) and coercive force. An increase in the remanence of Nd—Fe—B sintered magnets can be achieved by increasing the volume factor of $Nd_2Fe_{14}B$ compound and improving the crystal orientation. To this end, a number of modifications have been made on the process. For increasing coercive force, there are known different approaches including grain refinement, the use of alloy compositions with greater Nd contents, and the addition of effective elements. The currently most common approach is to use alloy compositions having Dy or Tb substituted for part of Nd. Substituting these elements for Nd in the $Nd_2Fe_{14}B$ compound increases both the anisotropic magnetic field and the coercive force of the compound. The substitution with Dy or Tb, on the other hand, reduces the saturation magnetic polarization of the compound. Therefore, as long as the above approach is taken to increase coercive force, a loss of remanence is unavoidable. Since Tb and Dy are expensive metals, it is desired to minimize their addition amount.

In Nd—Fe—B magnets, the coercive force is given by the magnitude of an external magnetic field created by nuclei of reverse magnetic domains at grain boundaries. Formation of nuclei of reverse magnetic domains is largely dictated by the structure of the grain boundary in such a manner that any disorder of grain structure in proximity to the boundary invites a disturbance of magnetic structure, helping formation of reverse magnetic domains. It is generally believed that a magnetic structure extending from the grain boundary to a depth of about 5 nm contributes to an increase of coercive force. It is difficult to acquire a morphology effective for increasing coercive force.

The documents pertinent to the present invention are listed below.

| | |
|---|---|
| Patent Document 1: | JP-B 5-31807 |
| Patent Document 2: | JP-A 5-21218 |
| Non-Patent Document 1: | K. D. Durst and H. Kronmuller, "THE COERCIVE FIELD OF SINTERED AND MELT-SPUN NdFeB MAGNETS," Journal of Magnetism and Magnetic Materials, 68 (1987), 63-75 |
| Non-Patent Document 2: | K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 257 (2000) |

-continued

| | |
|---|---|
| Non-Patent Document 3: | K. Machida, H. Kawasaki, S. Suzuki, M. Ito and T. Horikawa, "Grain Boundary Tailoring of Nd—Fe—B Sintered Magnets and Their Magnetic Properties," Proceedings of the 2004 Spring Meeting of the Powder & Powder Metallurgy Society, p. 202 |

DISCLOSURE OF THE INVENTION

Problem to Be Solved by the Invention

While the invention has been made in view of the above-discussed problems, its object is to provide a method for preparing a rare earth permanent magnet material in the form of R—Fe—B sintered magnet wherein R is two or more elements selected from rare earth elements inclusive of Sc and Y, the magnet exhibiting high performance despite a minimized amount of Tb or Dy used.

Means for Solving the Problem

The inventors discovered (in PCT/JP2005/5134) that when a R—Fe—B sintered magnet (wherein R is one or more elements selected from rare earth elements inclusive of Sc and Y), typically a Nd—Fe—B sintered magnet, with a powder based on one or more of an oxide of R, a fluoride of R and an oxyfluoride of R being disposed on the magnet surface, is heated at a temperature below the sintering temperature, R contained in the powder is absorbed in the magnet body so that Dy or Tb is concentrated only in proximity to grain boundaries for enhancing the anisotropic magnetic field only in proximity to the boundaries whereby the coercive force is increased while suppressing a decline of remanence. However, since Dy or Tb is fed from the magnet body surface, this method has a possibility that it becomes more difficult to attain the coercive force increasing effect as the magnet body becomes larger in size.

Further continuing the research, the inventors have discovered that when the step of heating an R—Fe—B sintered magnet (wherein R is one or more elements selected from rare earth elements inclusive of Sc and Y), typically a Nd—Fe—B sintered magnet, with a powder based on one or more of an oxide of R, a fluoride of R and an oxyfluoride of R being disposed on the magnet surface, at a temperature below the sintering temperature for thereby causing R in the powder to be absorbed in the magnet body is repeated at least two times, Dy or Tb is concentrated only in proximity to grain boundaries even in the case of relatively large-sized magnet bodies, for enhancing the anisotropic magnetic field only in proximity to the boundaries whereby the coercive force is increased while suppressing a decline of remanence. The invention is predicated on this discovery.

The invention provides a method for preparing a rare earth permanent magnet material, as defined below.

Embodiment 1

A method for preparing a rare earth permanent magnet material, comprising the steps of disposing a powder on a surface of a sintered magnet body of $R^1{}_aT_bA_cM_d$ composition wherein $R^1$ is at least one element selected from rare earth elements inclusive of Sc and Y, T is Fe and/or Co, A is boron (B) and/or carbon (C), M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and a to d indicative of atom percent based on the alloy are in the range: $10 \leqq a \leqq 15$, $3 \leqq c \leqq 15$, $0.01 \leqq d \leqq 11$, and the balance of b, said powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y and having an average particle size equal to or less than 100 μm, and heat treating the magnet body and the powder at a temperature equal to or below the sintering temperature of the magnet body in vacuum or in an inert gas for absorption treatment for causing at least one of $R^2$, $R^3$, and $R^4$ in said powder to be absorbed in said magnet body, and repeating the absorption treatment at least two times.

Embodiment 2

A method for preparing a rare earth permanent magnet material according to embodiment 1, wherein the sintered magnet body subject to absorption treatment with the powder has a minimum portion with a dimension equal to or less than 15 mm.

Embodiment 3

A method for preparing a rare earth permanent magnet material according to embodiment 1 or 2, wherein said powder is disposed on the sintered magnet body surface in an amount corresponding to an average filling factor of at least 10% by volume in a magnet body-surrounding space at a distance equal to or less than 1 mm from the sintered magnet body surface.

Embodiment 4

A method for preparing a rare earth permanent magnet material according to embodiment 1, 2 or 3, further comprising, after repeating at least two times the absorption treatment for causing at least one of $R^2$, $R^3$, and $R^4$ to be absorbed in said magnet body, subjecting the sintered magnet body to aging treatment at a lower temperature.

Embodiment 5

A method for preparing a rare earth permanent magnet material according to any one of embodiments 1 to 4, wherein each of $R^2$, $R^3$, and $R^4$ contains at least 10 atom % of Dy and/or Tb.

Embodiment 6

A method for preparing a rare earth permanent magnet material according to any one of embodiments 1 to 5, wherein said powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y and having an average particle size equal to or less than 100 μm is fed as a slurry dispersed in an aqueous or organic solvent.

Embodiment 7

A method for preparing a rare earth permanent magnet material according to any one of embodiments 1 to 6, further comprising, prior to the absorption treatment with the powder, washing the sintered magnet body with at least one agent selected from alkalis, acids, and organic solvents.

Embodiment 8

A method for preparing a rare earth permanent magnet material according to any one of embodiments 1 to 7, further comprising, prior to the absorption treatment with the powder, shot blasting the sintered magnet body for removing a surface layer.

Embodiment 9

A method for preparing a rare earth permanent magnet material according to any one of embodiments 1 to 8, further comprising washing the sintered magnet body with at least one agent selected from alkalis, acids, and organic solvents after the absorption treatment with the powder or after the aging treatment.

Embodiment 10

A method for preparing a rare earth permanent magnet material according to any one of embodiments 1 to 9, further comprising machining the sintered magnet body after the absorption treatment with the powder or after the aging treatment.

Embodiment 11

A method for preparing a rare earth permanent magnet material according to any one of embodiments 1 to 10, further comprising plating or coating the sintered magnet body, after the absorption treatment with the powder, after the aging treatment, after the alkali, acid or organic solvent washing step following the aging treatment, or after the machining step following the aging treatment.

Embodiment 12

A method for preparing a rare earth permanent magnet material according to any one of embodiments 1 to 11, wherein $R^1$ contains at least 10 atom % of Nd and/or Pr.

Embodiment 13

A method for preparing a rare earth permanent magnet material according to any one of embodiments 1 to 12, wherein T contains at least 60 atom % of Fe.

Embodiment 14

A method for preparing a rare earth permanent magnet material according to any one of embodiments 1 to 13, wherein A contains at least 80 atom % of boron (B).

BENEFITS OF THE INVENTION

According to the invention, a rare earth permanent magnet material can be prepared as an R—Fe—B sintered magnet with high performance and a minimized amount of Tb or Dy used.

DETAILED DESCRIPTION OF THE INVENTION

The invention pertains to a method for preparing an R—Fe—B sintered magnet exhibiting high performance and having a minimized amount of Tb or Dy used.

The invention starts with an R—Fe—B sintered magnet body which is obtainable from a mother alloy by a standard procedure including crushing, fine pulverization, compaction and sintering.

As used herein, both R and $R^1$ are selected from rare earth elements inclusive of Sc and Y. R is mainly used for the finished magnet body while $R^1$ is mainly used for the starting material.

The mother alloy contains $R^1$, T, A and optionally M. $R^1$ is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd, Pr and Dy being preferably predominant. It is preferred that rare earth elements inclusive of Sc and Y account for 10 to 15 atom %, more preferably 12 to 15 atom % of the overall alloy. Desirably $R^1$ contains at least 10 atom %, especially at least 50 atom % of Nd and/or Pr based on the entire $R^1$. T is one or both elements selected from iron (Fe) and cobalt (Co). The content of Fe is preferably at least 50 atom %, especially at least 65 atom % of the overall alloy. A is one or both elements selected from boron (B) and carbon (C). It is preferred that A account for 2 to 15 atom %, more preferably 3 to 8 atom % of the overall alloy. M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and may be contained in an amount of 0 to 11 atom %, especially 0.1 to 5 atom %. The balance consists of incidental impurities such as nitrogen (N) and oxygen (O).

The mother alloy is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R_2Fe_{14}B$ compound composition constituting the primary phase of the relevant alloy and an R-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R_2Fe_{14}B$ compound phase, since α-Fe is likely to be left depending on the cooling rate during casting and the alloy composition. The homogenizing treatment is a heat treatment at 700 to 1,200° C. for at least one hour in vacuum or in an Ar atmosphere. To the R-rich alloy serving as a liquid phase aid, the melt quenching and strip casting techniques are applicable as well as the above-described casting technique.

The alloy is generally crushed to a size of 0.05 to 3 mm, especially 0.05 to 1.5 mm. The crushing step uses a Brown mill or hydriding pulverization, with the hydriding pulverization being preferred for those alloys as strip cast. The coarse powder is then finely divided to a size of 0.2 to 30 μm, especially 0.5 to 20 μm, for example, by a jet mill using high-pressure nitrogen.

The fine powder is compacted on a compression molding machine under a magnetic field and then placed in a sintering furnace where it is sintered in vacuum or in an inert gas atmosphere usually at a temperature of 900 to 1,250° C., preferably 1,000 to 1,100° C. The sintered magnet thus obtained contains 60 to 99% by volume, preferably 80 to 98% by volume of the tetragonal $R_2Fe_{14}B$ compound as the primary phase, with the balance being 0.5 to 20% by volume of an R-rich phase, 0 to 10% by volume of a B-rich phase, and 0.1 to 10% by volume of at least one of R oxides, and carbides, nitrides and hydroxides resulting from incidental impurities, or a mixture or composite thereof.

The sintered magnet body thus obtained has a composition represented by ${R^1}_aT_bA_cM_d$ wherein $R^1$ is at least one element selected from rare earth elements inclusive of Sc and Y, T is iron (Fe) and/or cobalt (Co), A is boron (B) and/or carbon (C), M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and a to d indicative of atom percent based on the alloy are in the range: $10 \leqq a \leqq 15$, $3 \leqq c \leqq 15$, $0.01 \leqq d \leqq 11$, and the balance of b.

The resulting sintered magnet body is then machined or worked into a predetermined shape. Although its dimensions may be selected as appropriate, the shape preferably includes a minimum portion having a dimension equal to or less than 15 mm, more preferably of 0.1 to 10 mm and also preferably includes a maximum portion having a dimension of 0.1 to 200 mm, especially 0.2 to 150 mm. Any appropriate shape may be selected. For example, the magnet body may be worked into a plate or cylindrical shape.

Then a powder is disposed on the sintered magnet body, the powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y and having an average particle size equal to or less than 100 μm, after which the magnet body and the powder are heat treated at a temperature equal to or below the sintering temperature of the magnet body in vacuum or in an inert gas for 1 minute to 100 hours for absorption treatment for causing at least one of $R^2$, $R^3$, and $R^4$ in the powder to be absorbed in the magnet body. This heat treatment should be repeated at least two times.

It is noted that specific examples of $R^2$, $R^3$ and $R^4$ are the same as exemplified for $R^1$ while $R^1$ may be identical with or different from $R^2$, $R^3$ and $R^4$. When the heat treatment is repeated, $R^2$, $R^3$ and $R^4$ may be identical or different among repeated treatments.

In the powder comprising at least one compound selected from among an oxide of $R^2$, a fluoride of $R^3$, and an oxyfluoride of $R^4$, it is desired for the objects of the invention that $R^2$, $R^3$ or $R^4$ contain at least 10 atom %, more preferably at least 20 atom %, most preferably 40 to 100 atom % of Dy and/or Tb and that the total concentration of Nd and Pr in $R^2$, $R^3$ or $R^4$ is lower than the concentration of Nd and Pr in $R^1$.

Also in the powder comprising at least one compound selected from among an oxide of $R^2$, a fluoride of $R^3$, and an oxyfluoride of $R^4$, it is preferred for effective absorption of R that the powder contain at least 40% by weight of the $R^3$ fluoride and/or the $R^4$ oxyfluoride and the balance of one or more components selected from the $R^2$ oxide and carbides, nitrides, oxides, hydroxides, and hydrides of $R^5$ wherein $R^5$ is at least one element selected from rare earth elements inclusive of Sc and Y.

The oxide of $R^2$, fluoride of $R^3$, and oxyfluoride of $R^4$ used herein are typically ${R^2}_2O_3$, $R^3F_3$, and $R^4OF$, respectively, although they generally refer to oxides containing $R^2$ and oxygen, fluorides containing $R^3$ and fluorine, and oxyfluorides containing $R^4$, oxygen and fluorine, additionally including $R^2O_n$, $R^3F_n$, and $R^4O_mF_n$ wherein m and n are arbitrary positive numbers, and modified forms in which part of $R^2$ to $R^4$ is substituted or stabilized with another metal element as long as they can achieve the benefits of the invention.

The powder disposed on the magnet surface contains the oxide of $R^2$, fluoride of $R^3$, oxyfluoride of $R^4$ or a mixture thereof, and may additionally contain at least one compound selected from among hydroxides, carbides, and nitrides of $R^2$ to $R^4$, or a mixture or composite thereof. Further, the powder may contain a fine powder of boron, boron nitride, silicon, carbon or the like, or an organic compound such as stearic acid in order to promote the dispersion or chemical/physical adsorption of the powder. In order for the invention to attain its effect efficiently, the powder may contain at least 40% by weight, preferably at least 60% by weight, even more preferably at least 80% by weight (based on the entire powder) of the oxide of $R^2$, fluoride of $R^3$, oxyfluoride of $R^4$ or a mixture thereof, with even 100% by weight being acceptable.

Through the treatment described above, at least one of $R^2$, $R^3$ and $R^4$ is absorbed within the magnet body. For the reason that a more amount of $R^2$, $R^3$ or $R^4$ is absorbed as the filling factor of the powder in the magnet surface-surrounding space is higher, the filling factor should preferably be at least 10% by volume, more preferably at least 40% by volume, calculated as an average value in the magnet surrounding space from the magnet surface to a distance equal to or less than 1 mm. The upper limit of filling factor is generally equal to or less than 95% by volume, and especially equal to or less than 90% by volume, though not particularly restrictive.

One exemplary technique of disposing or applying the powder is by dispersing a powder comprising one or more compounds selected from an oxide of $R^2$, a fluoride of $R^3$, and an oxyfluoride of $R^4$ in water or an organic solvent to form a slurry, immersing the magnet body in the slurry, and drying in hot air or in vacuum or drying in the ambient air. Alternatively, the powder can be applied by spray coating or the like. Any such technique is characterized by ease of application and mass treatment. Specifically the slurry may contain the powder in a concentration of 1 to 90% by weight, more specifically 5 to 70% by weight.

The particle size of the powder affects the reactivity when the $R^2$, $R^3$ or $R^4$ component in the powder is absorbed in the magnet. Smaller particles offer a larger contact area that participates in the reaction. In order for the invention to attain its effects, the powder disposed on the magnet should desirably have an average particle size equal to or less than 100 μm, preferably equal to or less than 10 μm. No particular lower limit is imposed on the particle size although a particle size of at least 1 nm, especially at least 10 nm is preferred. It is noted that the average particle size is determined as a weight average diameter $D_{50}$ (particle diameter at 50% by weight cumulative, or median diameter) using, for example, a particle size distribution measuring instrument relying on laser diffractometry or the like.

The amount of at least one element selected from $R^2$, $R^3$ and $R^4$ absorbed depends on the size of the magnet body as well as the above-described factors. Accordingly, even when the amount of the powder disposed on the magnet body surface is optimized, the absorbed amount per magnet body unit weight decreases with the increasing size of the magnet body. Repeating the heat treatment two or more times is effective in attaining further enhancement of coercive force. Since more rare earth component is taken into the magnet body by repeating the treatment plural times, the repeated treatment is effective particularly for large-sized magnet bodies. The number of repetitions is determined appropriate in accordance with the amount of powder disposed and the size of a magnet body and is preferably 2 to 10 times, and more preferably 2 to 5 times. Also, since the rare earth component absorbed is concentrated in proximity to grain boundaries, the rare earth in the oxide of $R^2$, fluoride of $R^3$ or oxyfluoride of $R^4$ should preferably contain at least 10 atom %, more preferably at least 20 atom %, and even more preferably at least 40 atom % of Tb and/or Dy.

After the powder comprising at least one selected from the oxide of $R^2$, fluoride of $R^3$, and oxyfluoride of $R^4$ is disposed on the magnet body surface as described above, the magnet body and the powder are heat treated at a temperature equal to or below the sintering temperature (designated Ts in ° C.) in vacuum or in an atmosphere of an inert gas such as Ar or He. The temperature of heat treatment is equal to or below Ts° C. of the magnet body, preferably equal to or below (Ts-10)° C., and more preferably equal to or below (Ts-20)° C. The lower limit of temperature is preferably at least 210° C., more preferably at least 360° C. The time of heat treatment, which varies with the heat treatment temperature, is preferably from 1 minute to 100 hours, more preferably from 5 minutes to 50 hours, and even more preferably from 10 minutes to 20 hours.

After the absorption treatment is repeated as described above, the resulting sintered magnet body is preferably subjected to aging treatment. The aging treatment is desirably at a temperature which is below the absorption treatment temperature, preferably from 200° C. to a temperature lower than the absorption treatment temperature by 10° C. The time of aging treatment is preferably from 1 minute to 10 hours, more preferably from 10 minutes to 8 hours.

Prior to the repetitive absorption treatment, the sintered magnet body as worked into the predetermined shape may be washed with at least one of alkalis, acids and organic solvents or shot blasted for removing a surface affected layer.

Also, after the repetitive absorption treatment or after the aging treatment, the sintered magnet body may be washed with at least one agent selected from alkalis, acids and organic solvents, or machined again. Alternatively, plating or paint coating may be carried out after the repetitive absorption treatment, after the aging treatment, after the washing step, or after the machining step.

Suitable alkalis which can be used herein include potassium pyrophosphate, sodium pyrophosphate, potassium citrate, sodium citrate, potassium acetate, sodium acetate, potassium oxalate, sodium oxalate, etc.; suitable acids include hydrochloric acid, nitric acid, sulfuric acid, acetic acid, citric acid, tartaric acid, etc.; and suitable organic solvents include acetone, methanol, ethanol, isopropyl alcohol, etc. In the washing step, the alkali or acid may be used as an aqueous solution with a suitable concentration not attacking the magnet body.

The above-described washing, shot blasting, machining, plating, and coating steps may be carried out by standard techniques.

The permanent magnet material thus obtained can be used as high-performance permanent magnets.

EXAMPLE

Examples and Comparative Examples are given below for further illustrating some embodiments of the invention although the invention is not limited thereto. In Examples, the filling factor (or percent occupancy) of the magnet surface-surrounding space with powder like terbium fluoride is calculated from a dimensional change and weight gain of the magnet after powder treatment and the true density of powder material.

Example 1 and Comparative Example 1

An alloy in thin plate form was prepared by a strip casting technique, specifically by using Nd, Pr, Al, Fe and Cu metals having a purity of at least 99% by weight and ferroboron, high-frequency heating in an argon atmosphere for melting, and casting the alloy melt on a copper single roll. The resulting alloy consisted of 12.0 atom % Nd, 1.5 atom % Pr, 0.4 atom % Al, 0.2 atom % Cu, 6.0 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 5.0 μm. The resulting fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 50 mm×20 mm×8 mm (thick). It was successively washed with alkaline solution, deionized water, nitric acid, and deionized water, and dried.

Subsequently, terbium fluoride was mixed with deionized water at a weight fraction of 50% to form a suspension, in which the magnet body was immersed for 1 minute with ultrasonic waves being applied. It is noted that the terbium fluoride powder had an average particle size of 1 μm. The magnet body was pulled up and immediately dried with hot air. At this point, the terbium fluoride surrounded the magnet and occupied a space spaced from the magnet surface at an average distance of 5 μm at a filling factor of 45% by volume. The magnet body covered with terbium fluoride was subjected to absorption treatment in an argon atmosphere at 800° C. for 12 hours. The magnet body was cooled, taken out, immersed in the suspension, and dried, after which it was subjected to absorption treatment under the same conditions.

It was then subjected to aging treatment at 500° C. for one hour, and quenched, obtaining a magnet body within the scope of the invention. This magnet body is designated M1.

For comparison purposes, magnet bodies were prepared by subjecting the magnet body to only heat treatment, and by effecting the absorption treatment only once. They are designated P1 and Q1 (Comparative Examples 1-1 and 1-2).

Magnetic properties of magnet bodies M1, P1 and Q1 are shown in Table 1. It is evident that the magnet within the scope of the invention has a coercive force increase of 800 kAm$^{-1}$ relative to the coercive force of magnet P1 not subjected to absorption treatment with terbium fluoride. The magnet Q1 subjected to a single absorption treatment has a coercive force increase of 450 kAm$^{-1}$ relative to magnet P1. It is demonstrated that the repetitive treatment is effective for enhancing coercive force.

Example 2 and Comparative Example 2

An alloy in thin plate form was prepared by a strip casting technique, specifically by using Nd, Al and Fe metals having a purity of at least 99% by weight and ferroboron, high-frequency heating in an argon atmosphere for melting, and casting the alloy melt on a copper single roll. The resulting alloy consisted of 13.7 atom % Nd, 0.5 atom % Al, 5.9 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

Separately, an ingot was prepared by using Nd, Tb, Fe, Co, Al and Cu metals having a purity of at least 99% by weight and ferroboron, high-frequency heating in an argon atmosphere for melting, and casting the alloy melt into a flat mold. The ingot consisted of 20 atom % Nd, 10 atom % Tb, 24 atom % Fe, 6 atom % B, 1 atom % Al, 2 atom % Cu, and the balance of Co. The alloy was ground on a jaw crusher and a Brown mill in a nitrogen atmosphere and sieved, obtaining a coarse powder under 50 mesh.

The two powders were mixed in a weight fraction of 90:10. On a jet mill using high-pressure nitrogen gas, the mixed powder was pulverized into a fine powder having a mass median particle diameter of 4.5 μm. The resulting mixed fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 40 mm×15 mm×6 mm (thick). It was successively washed with alkaline solution, deionized water, nitric acid, and deionized water, and dried.

Subsequently, dysprosium fluoride was mixed with deionized water at a weight fraction of 50% to form a suspension, in which the magnet body was immersed for 1 minute with ultrasonic waves being applied. It is noted that the dysprosium fluoride powder had an average particle size of 2 μm. The magnet body was pulled up and immediately dried with hot air. At this point, the dysprosium fluoride surrounded the magnet and occupied a space spaced from the magnet surface at an average distance of 7 μm at a filling factor of 50% by volume. The magnet body covered with dysprosium fluoride was subjected to absorption treatment in an argon atmosphere at 850° C. for 10 hours. The magnet body was cooled, taken out, immersed in the suspension, and dried, after which it was subjected to absorption treatment under the same conditions.

It was then subjected to aging treatment at 500° C. for one hour, and quenched, obtaining a magnet body within the scope of the invention. This magnet body is designated M2.

For comparison purposes, magnet bodies were prepared by subjecting the magnet body to only heat treatment, and by effecting the absorption treatment only once. They are designated P2 and Q2 (Comparative Examples 2-1 and 2-2).

Magnetic properties of magnet bodies M2, P2 and Q2 are shown in Table 1. It is evident that the magnet within the scope of the invention has a coercive force increase of 300 kAm$^{-1}$ relative to the coercive force of magnet P2 not subjected to absorption treatment with dysprosium fluoride. The magnet Q2 subjected to a single absorption treatment has a coercive force increase of 160 kAm$^{-1}$ relative to magnet P2. It is demonstrated that the repetitive treatment is effective for enhancing coercive force.

Example 3 and Comparative Example 3

An alloy in thin plate form was prepared by a strip casting technique, specifically by using Nd, Dy, Al and Fe metals having a purity of at least 99% by weight and ferroboron, high-frequency heating in an argon atmosphere for melting, and casting the alloy melt on a copper single roll. The resulting alloy consisted of 12.7 atom % Nd, 1.5 atom % Dy, 0.5 atom % Al, 6.0 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.5 μm. The resulting fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 25 mm×20 mm×5 mm (thick). It was successively washed with alkaline solution, deionized water, nitric acid, and deionized water, and dried.

Subsequently, terbium fluoride was mixed with deionized water at a weight fraction of 50% to form a suspension, in which the magnet body was immersed for 1 minute with ultrasonic waves being applied. It is noted that the terbium fluoride powder had an average particle size of 1 μm. The magnet body was pulled up and immediately dried with hot air. At this point, the terbium fluoride surrounded the magnet and occupied a space spaced from the magnet surface at an average distance of 5 μm at a filling factor of 55% by volume. The magnet body covered with terbium fluoride was subjected to absorption treatment in an argon atmosphere at 820° C. for 15 hours. The magnet body was cooled, taken out, immersed in the suspension, and dried, after which it was subjected to absorption treatment under the same conditions.

It was then subjected to aging treatment at 500° C. for one hour, and quenched, obtaining a magnet body within the scope of the invention. This magnet body is designated M3.

For comparison purposes, magnet bodies were prepared by subjecting the magnet body to only heat treatment, and by effecting the absorption treatment only once. They are designated P3 and Q3 (Comparative Examples 3-1 and 3-2).

Magnetic properties of magnet bodies M3, P3 and Q3 are shown in Table 1. It is evident that the magnet within the scope of the invention has a coercive force increase of 600 $kAm^{-1}$ relative to the coercive force of magnet P3 not subjected to absorption treatment with terbium fluoride. The magnet Q3 subjected to a single absorption treatment has a coercive force increase of 350 $kAm^{-1}$ relative to magnet P3. It is demonstrated that the repetitive treatment is effective for enhancing coercive force.

Examples 4 to 8 and Comparative Examples 4 to 8

An alloy in thin plate form was prepared by a strip casting technique, specifically by using Nd, Pr, Al, Fe, Cu, Si, V, Mo, Zr and Ga metals having a purity of at least 99% by weight and ferroboron, high-frequency heating in an argon atmosphere for melting, and casting the alloy melt on a copper single roll. The resulting alloy consisted of 11.8 atom % Nd, 2.0 atom % Pr, 0.4 atom % Al, 0.3 atom % Cu, 0.3 atom % M (=Si, V, Mo, Zr or Ga), 6.0 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.7 μm. The resulting fine powder was compacted in a nitrogen atmosphere under a pressure of about 1 $ton/cm^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 40 mm×20 mm×7 mm (thick). It was successively washed with alkaline solution, deionized water, citric acid, and deionized water, and dried.

Subsequently, a powder mixture of dysprosium fluoride and terbium fluoride at a weight fraction of 50:50 was mixed with deionized water at a weight fraction of 50% to form a suspension, in which the magnet body was immersed for 30 seconds with ultrasonic waves being applied. It is noted that the dysprosium fluoride and terbium fluoride powders had an average particle size of 2 μm and 1 μm, respectively. The magnet body was pulled up and immediately dried with hot air. At this point, the powder mixture surrounded the magnet and occupied a space spaced from the magnet surface at an average distance of 10 μm at a filling factor of 40-50% by volume. The magnet body covered with dysprosium fluoride and terbium fluoride was subjected to absorption treatment in an argon atmosphere at 850° C. for 10 hours. The magnet body was cooled, taken out, immersed in the suspension, and dried, after which it was subjected to absorption treatment under the same conditions.

It was then subjected to aging treatment at 500° C. for one hour, and quenched, obtaining a magnet body within the scope of the invention. Those magnet bodies wherein additive element M=Si, V, Mo, Zr and Ga are designated M4 to M8 in sequence.

For comparison purposes, magnet bodies were prepared by subjecting the magnet body to only heat treatment, and by effecting the absorption treatment only once. They are likewise designated P4 to P8 and Q4 to Q8 (Comparative Examples 4-1 to 8-1 and 4-2 to 8-2).

Magnetic properties of magnet bodies M4 to M8, P4 to P8 and Q4 to Q8 are shown in Table 1. It is evident that magnets M4 to M8 within the scope of the invention has a coercive force increase of at least 350 $kAm^{-1}$ relative to the coercive force of magnets P4 to P8 not subjected to absorption treatment with dysprosium fluoride and terbium fluoride. The magnets Q4 to Q8 subjected to a single absorption treatment have a little coercive force increase as compared with M4 to M8. It is demonstrated that the repetitive treatment is effective for enhancing coercive force.

Example 9 and Comparative Example 9

An alloy in thin plate form was prepared by a strip casting technique, specifically by using Nd, Dy, Al and Fe metals having a purity of at least 99% by weight and ferroboron, high-frequency heating in an argon atmosphere for melting, and casting the alloy melt on a copper single roll. The resulting alloy consisted of 12.3 atom % Nd, 1.5 atom % Dy, 0.5 atom % Al, 5.8 atom % B, and the balance of Fe. The alloy was exposed to 0.11 MPa of hydrogen gas at room temperature for hydriding and then heated at 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.0 μm. The resulting fine powder was compacted in a nitrogen atmosphere under a pressure of about 1 $ton/cm^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 30 mm×20 mm×8 mm (thick). It was successively washed with alkaline solution, deionized water, nitric acid, and deionized water, and dried.

Subsequently, terbium fluoride was mixed with deionized water at a weight fraction of 50% to form a suspension, in which the magnet body was immersed for 1 minute with ultrasonic waves being applied. It is noted that the terbium fluoride powder had an average particle size of 1 μm. The magnet body was pulled up and immediately dried with hot air. At this point, the terbium fluoride surrounded the magnet and occupied a space spaced from the magnet surface at an average distance of 5 μm at a filling factor of 45% by volume. The magnet body covered with terbium fluoride was subjected to absorption treatment in an argon atmosphere at 800° C. for 10 hours. The treatment consisting of successive steps of cooling the magnet body, taking out, immersing in the suspension, drying, and subjecting to absorption treatment under the same conditions was carried out three more times.

It was then subjected to aging treatment at 500° C. for one hour, and quenched, obtaining a magnet body within the scope of the invention. This magnet body is designated M9.

For comparison purposes, magnet bodies were prepared by subjecting the magnet body to only heat treatment, and by effecting the absorption treatment only once. They are designated P9 and Q9 (Comparative Examples 9-1 and 9-2).

Magnetic properties of magnet bodies M9, P9 and Q9 are shown in Table 1. It is evident that the magnet within the scope of the invention has a coercive force increase of 850 $kAm^{-1}$ relative to the coercive force of magnet P9 not subjected to absorption treatment with terbium fluoride. The magnet Q9 subjected to a single absorption treatment has a coercive force increase of 350 $kAm^{-1}$ relative to magnet P9. It is demonstrated that the repetitive treatment is effective for enhancing coercive force.

Examples 10 to 13

Magnet body M1 (dimensioned 50×20×8 mm thick) in Example 1 was washed with 0.5N nitric acid for 2 minutes, rinsed with deionized water, and immediately dried with hot air. This magnet body within the scope of the invention is designated M10. Separately, magnet body M1 was machined on its 50×20 surface by an outer blade cutter, obtaining a magnet body dimensioned 10 mm×5 mm×8 mm (thick). This magnet body within the scope of the invention is designated M11. The magnet body M11 was further subjected to epoxy coating or electric copper/nickel plating. These magnet bodies within the scope of the invention are designated M12 and M13. Magnetic properties of magnet bodies M10 to M13 are shown in Table 1. It is evident that all these magnet bodies exhibit high magnetic properties.

TABLE 1

| | | $B_r$ (T) | $H_{cJ}$ ($kAm^{-1}$) | $(BH)_{max}$ ($kJ/m^3$) |
|---|---|---|---|---|
| Example 1 | M1 | 1.410 | 1840 | 388 |
| Example 2 | M2 | 1.415 | 1260 | 391 |
| Example 3 | M3 | 1.345 | 1960 | 353 |
| Example 4 | M4 | 1.400 | 1520 | 380 |
| Example 5 | M5 | 1.395 | 1480 | 379 |
| Example 6 | M6 | 1.390 | 1430 | 377 |
| Example 7 | M7 | 1.395 | 1560 | 382 |
| Example 8 | M8 | 1.390 | 1660 | 375 |
| Example 9 | M9 | 1.340 | 2210 | 350 |
| Example 10 | M10 | 1.410 | 1845 | 389 |
| Example 11 | M11 | 1.405 | 1835 | 386 |
| Example 12 | M12 | 1.410 | 1840 | 386 |
| Example 13 | M13 | 1.410 | 1840 | 386 |
| Comparative Example 1-1 | P1 | 1.420 | 1040 | 393 |
| Comparative Example 2-1 | P2 | 1.430 | 960 | 399 |
| Comparative Example 3-1 | P3 | 1.355 | 1360 | 358 |
| Comparative Example 4-1 | P4 | 1.410 | 1060 | 386 |
| Comparative Example 5-1 | P5 | 1.400 | 1010 | 382 |
| Comparative Example 6-1 | P6 | 1.400 | 1080 | 384 |
| Comparative Example 7-1 | P7 | 1.410 | 1060 | 388 |
| Comparative Example 8-1 | P8 | 1.405 | 1100 | 383 |
| Comparative Example 9-1 | P9 | 1.360 | 1360 | 361 |
| Comparative Example 1-2 | Q1 | 1.410 | 1490 | 389 |

TABLE 1-continued

| | | $B_r$ (T) | $H_{cJ}$ ($kAm^{-1}$) | $(BH)_{max}$ ($kJ/m^3$) |
|---|---|---|---|---|
| Comparative Example 2-2 | Q2 | 1.420 | 1120 | 393 |
| Comparative Example 3-2 | Q3 | 1.345 | 1710 | 354 |
| Comparative Example 4-2 | Q4 | 1.400 | 1300 | 382 |
| Comparative Example 5-2 | Q5 | 1.400 | 1260 | 380 |
| Comparative Example 6-2 | Q6 | 1.390 | 1285 | 379 |
| Comparative Example 7-2 | Q7 | 1.395 | 1330 | 383 |
| Comparative Example 8-2 | Q8 | 1.395 | 1400 | 379 |
| Comparative Example 9-2 | Q9 | 1.350 | 1710 | 355 |

The invention claimed is:

1. A method for preparing a rare earth permanent magnet material, comprising a disposing step of disposing a powder on a surface of a sintered magnet body of $R^1{}_aT_bA_cM_d$ composition wherein $R^1$ is at least one element selected from rare earth elements inclusive of Sc and Y, T is Fe and/or Co, A is boron (B) and/or carbon (C), M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and a to d indicative of atom percent based on the alloy are in the range: $10 \leqq a \leqq 15$, $3 \leqq c \leqq 15$, $0.01 \leqq d \leqq 11$, and the balance of b, said powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y and having an average particle size equal to or less than 100 μm, and then a heat treating step of heat treating the sintered magnet body and the powder at a temperature equal to or below the sintering temperature of the magnet body in vacuum or in an inert gas for absorption treatment for causing at least one of $R^2$, $R^3$, and $R^4$ in said powder to be absorbed in said magnet body, a cooling step of cooling the magnet body after the heat treating step;

followed by repeating the disposing step, the heat treating step and the cooling step, in the recited order, at least two times.

2. The method for preparing a rare earth permanent magnet material according to claim 1, wherein the sintered magnet body subject to absorption treatment with the powder has a minimum portion with a dimension equal to or less than 15 mm.

3. The method for preparing a rare earth permanent magnet material according to claim 1, wherein said powder is disposed on the sintered magnet body surface in an amount corresponding to an average filling factor of at least 10% by volume in a magnet body-surrounding space at a distance equal to or less than 1 mm from the sintered magnet body surface.

4. The method for preparing a rare earth permanent magnet material according to claim 1, further comprising, after repeating at least two times the heat treating step of said sintered magnet body, subjecting the sintered magnet body to aging treatment at a lower temperature than the temperature of the heat treating step for absorption treatment.

5. The method for preparing a rare earth permanent magnet material according to claim 1, wherein each of $R^2$, $R^3$, and $R^4$ contains at least 10 atom % of Dy and/or Tb.

6. The method for preparing a rare earth permanent magnet material according to claim 1, wherein said powder comprising at least one compound selected from among an oxide of $R^2$, a fluoride of $R^3$, and an oxyfluoride of $R^4$ wherein each of $R^2$, $R^3$, and $R^4$ is at least one element selected from rare earth elements inclusive of Sc and Y and having an average particle size equal to or less than 100 μm is fed as a slurry dispersed in an aqueous or organic solvent.

7. The method for preparing a rare earth permanent magnet material according to claim 1, further comprising, prior to the first heat treating step for absorption treatment with the powder, washing the sintered magnet body with at least one agent selected from alkalis, acids, and organic solvents.

8. The method for preparing a rare earth permanent magnet material according to claim 1, further comprising, prior to the first heat treating step for absorption treatment with the powder, shot blasting the sintered magnet body for removing a surface layer.

9. The method for preparing a rare earth permanent magnet material according to claim 1, further comprising washing the sintered magnet body with at least one agent selected from alkalis, acids, and organic solvents after the final cooling step.

10. The A method for preparing a rare earth permanent magnet material according to any claim 1, further comprising machining the sintered magnet body after the final cooling step.

11. The A method for preparing a rare earth permanent magnet material according to claim 1, further comprising plating or coating the sintered magnet body, after the final cooling step.

12. The A method for preparing a rare earth permanent magnet material according to claim 1, wherein $R^1$ contains at least 10 atom % of Nd and/or Pr.

13. The method for preparing a rare earth permanent magnet material according to claim 1, wherein T contains at least 60 atom % of Fe.

14. The method for preparing a rare earth permanent magnet material according to claim 1, wherein A contains at least 80 atom % of boron (B).

15. The method for preparing a rare earth permanent magnet material according to claim 4, further comprising washing the sintered magnet body with at least one agent selected from alkalis, acids, and organic solvents after the aging treatment.

16. The method for preparing a rare earth permanent magnet material according to claim 4, further comprising machining the sintered magnet body after the aging treatment.

17. The method for preparing a rare earth permanent magnet material according to claim 4, further comprising plating or coating the sintered magnet body, after the aging treatment.

18. The method for preparing a rare earth permanent magnet material according to claim 15, further comprising plating or coating the sintered magnet body, after the alkali, acid or organic solvent washing step following the aging treatment.

19. The method for preparing a rare earth permanent magnet material according to claim 16, further comprising plating or coating the sintered magnet body, after the machining step following the aging treatment.

20. The method for preparing a rare earth permanent magnet material according to claim 1, wherein the disposing step, the heat treating step and the cooling step are repeated at least five times.

21. The method for preparing a rare earth permanent magnet material according to claim 1, wherein the disposing step, the heat treating step and the cooling step are repeated at least ten times.

22. The method for preparing a rare earth permanent magnet material according to claim 20, further comprising, after repeating at least five times the cooling step, subjecting the sintered magnet body to aging treatment at a lower temperature than the temperature of the heat treating step for absorption treatment.

23. The method for preparing a rare earth permanent magnet material according to claim 20, further comprising, after repeating at least ten times the cooling step, subjecting the sintered magnet body to aging treatment at a lower temperature than the temperature of the heat treating step for absorption treatment.

* * * * *